US005691676A

United States Patent [19]

Snel et al.

[11] Patent Number: 5,691,676

[45] Date of Patent: Nov. 25, 1997

[54] STRIP LINE FILTER, RECEIVER WITH STRIP LINE FILTER AND METHOD OF TUNING THE STRIP LINE FILTER

[75] Inventors: Jan Snel; Franciscus H.A. De Jongh; Pieter W. Jedeloo; Antonius C.J.C. Van De Acker-veken, all of Roermond, Netherlands

[73] Assignee: U.S. Philips Corporation, New York, N.Y.

[21] Appl. No.: 573,852

[22] Filed: Dec. 18, 1995

[30] Foreign Application Priority Data

Dec. 19, 1994 [EP] European Pat. Off. ..... 94203675

[51] Int. Cl.[6] ..... H01P 1/203

[52] U.S. Cl. ..... 333/204; 333/205; 455/307

[58] Field of Search ..... 333/202, 204, 333/205, 219, 235; 455/307, 325, 327

[56] References Cited

U.S. PATENT DOCUMENTS

| | | | |
|---|---|---|---|
| 4,157,517 | 6/1979 | Kneisel et al. | 333/205 |
| 4,612,689 | 9/1986 | De Wild et al. | 29/25.42 |
| 5,311,159 | 5/1994 | Miura et al. | 333/204 |
| 5,323,391 | 6/1994 | Harrison | 455/307 X |

FOREIGN PATENT DOCUMENTS

| | | | |
|---|---|---|---|
| 0541397A1 | 5/1993 | European Pat. Off. | C04B 35/46 |
| 0597700 | 5/1994 | European Pat. Off. | 333/202 |
| 1628109 | 2/1991 | U.S.S.R. | 333/202 |

OTHER PUBLICATIONS

"Microwave Filters, Impedance Matching Networks and Coupling Structures", by G.L. Matthaei et al, McGraw-Hill Co., 1964, pp. 217–229.

"Rectangular Bars Coupled Through a Finite-Thickness Slot", by J.H. Cloete, IEEE Transactions on Microwave Theory and Techniques, vol. MTT-32, No. 1, Jan. 1984, pp. 39–46.

*Primary Examiner*—Benny Lee
*Assistant Examiner*—Barbara Summons
*Attorney, Agent, or Firm*—Jack E. Haken

[57] ABSTRACT

Strip line filter, receiver with strip line filter and method of tuning the strip line filter. In ceramic filters for frequencies from 1 to 2 GHz, strip line resonators lying in one plane and coupled via the side are currently used in the state of the art. For reducing the attenuating effect of such a filter in the passband, the strip line resonators are arranged in two different planes and coupled via the broad side.

18 Claims, 4 Drawing Sheets

STRIP LINE FILTER, RECEIVER WITH STRIP LINE FILTER AND METHOD OF TUNING THE STRIP LINE FILTER

BACKGROUND OF THE INVENTION

The invention relates to a filter comprising at least two mutually electromagnetically coupled strip line resonators, which strip line resonators are separated by a ceramic dielectric.

The invention likewise relates to a receiver that includes such a strip line filter, and to a method of tuning such a filter.

A filter as defined in the opening paragraph is known from published European Patent Application 541 397.

Such filters are especially used in transmitters and receivers for high-frequency signals. Examples of suchlike transmitters and receivers are GSM, PCN and DECT.

GSM (Global System for Mobile Communication) is a digital cellular mobile telephony system which utilizes high-frequency signals in the 900 MHz band.

PCN (Personal Communication Network) is a digital cellular mobile telephony system intended for small portable telephones and utilizes a frequency of 1800 MHz.

DECT (Digital European Cordless Telephone) is especially intended for cordless telephony over a relatively short distance between the wireless telephone and the dedicated base station. DECT operates as does PCN at a frequency of about 1800 MHz.

The present filters are especially used for suppressing undesired signals that have a frequency lying outside the range assigned to that particular system. This suppression is necessary, because without filtering, the receiver may easily be overloaded by strong transmitters transmitting from outside this range.

The known filter utilizes at least two mutually coupled strip line resonators. The input and output of the filter may be coupled to the resonator in different ways. Several examples of such a coupling are described in the book entitled "Microwave Filters, Impedance Matching Networks and Coupling Structures" by G. L. Matthaei, L. Young and E. M. T. Jones, published by Mc Graw-Hill Book Company 1964, pages 217–229. The strip line resonators are accommodated in a dielectric which contains a multilayer material e.g. a ceramic material. The advantage of the use of ceramic dielectrics is their high relative dielectric constant, which results in small dimensions of the filter which, in portable telephones, is highly important. Usable materia may have a relative dielectric constant of about 70. This results in a reduction of the dimensions of the filter by a factor of 8.4.

Experiments have shown that the attenuation of the filter in the passband is rather high, which leads to a reduced sensitivity of the receiver in which such a filter is used.

SUMMARY OF THE INVENTION

It is an object of the invention to provide a filter as defined in the opening paragraph in which the attenuation in the passband is reduced.

For this purpose the invention is characterized in that the strip line resonators are situated in different planes and are mutually electromagnetically coupled at least via the broad side.

The invention is based on the recognition that the large attenuation in the passband is caused by the cross-section of the strip line resonators accommodated in the ceramic dielectric not being rectangular, but ending in a point on both sides. This means that the resistance of the strip line resonator at both ends will be relatively large. As the coupling between the strip line resonators in the filter known from said Patent Application is mainly effected via the region in the neighbourhood of the sides, this increased resistance has a detrimental effect on the attenuation in the passband.

By depositing the strip line resonators in two planes and coupling them via the broad side, this coupling takes place especially in the middle of the strip line resonator where the resistance is much lower than on the sides.

There is observed that the coupling of strip line resonators via the broad side is known per se from the journal article "Rectangular Bars Coupled Through a Finite-Thickness Slot" by J. H. Cloete in IEEE Transactions on Microwave Theory and Techniques, Vol. MTT-32, No. 1, January 1984. However, in this document a ceramic technique filter is not discussed at all. In addition, said journal article does not give any indication that the problem of the attenuation of the filter in state-of-the-art ceramic technology can be solved by coupling the strip line resonators by the broad sides. For that matter, in the strip line resonators according to the journal article the cross-sections of the strip line resonators are purely rectangular.

An embodiment of the invention is characterized in that the filter also comprises at least one conductor for influencing the electromagnetic field in the neighbourhood of at least one of the strip line resonators, which conductor has a length that is smaller than the length of one of the strip line resonators.

By arranging a conductor to affect the electromagnetic field in the neighbourhood of at least one of the strip line resonators, the filter can be tuned. By applying the conductor, the capacitance seen from the strip line resonator is increased, so that the resonance frequency of the resonator will decrease. The resonance frequency of the strip line resonator will decrease as the length of the conductor increases. When the filter is initially manufactured, the length of the conductor is smiler than that of the strip line resonators, but larger than the value that belongs to the nominal resonance frequency of the strip line resonators. By reducing the length of the conductor, for example, by removing material from the conductor by a laser, the resonance frequency of the strip line resonators can be tuned.

A further embodiment of the invention is characterized in that the filter comprises at least a further conductor which has a coupling opening located between the strip line resonators.

For realising a desired transfer function of the filter, the coupling factor between the strip line resonators is to have a predefined value. This coupling factor depends, for example, on the distance between the strip line resonators. It appears that the desired coupling factor may lead to a relatively large distance between the strip line resonators, which leads to relatively large dimensions of the filter. By inserting a further conductor with a coupling opening between the strip line resonators, the necessary distance between the strip line resonators may be reduced considerably. The coupling factor may then be determined by a suitable choice of dimensions and shape of the coupling opening.

A further embodiment of the invention is characterized in that the strip line resonators are shifted sideways.

By shifting the strip line resonators sideways, the coupling factor can be reduced. In addition, there is achieved that the electromagnetic field in the region not located between the strip line resonators is enlarged. As a consequence, the influence of the conductor increases, so that the tuning range of the filter increases likewise.

These and other aspects of the invention will be apparent from and elucidated with reference to the embodiments described hereinafter.

DETAILED DESCRIPTION OF THE PREFERRED EMBODIMENTS

Figure 1:
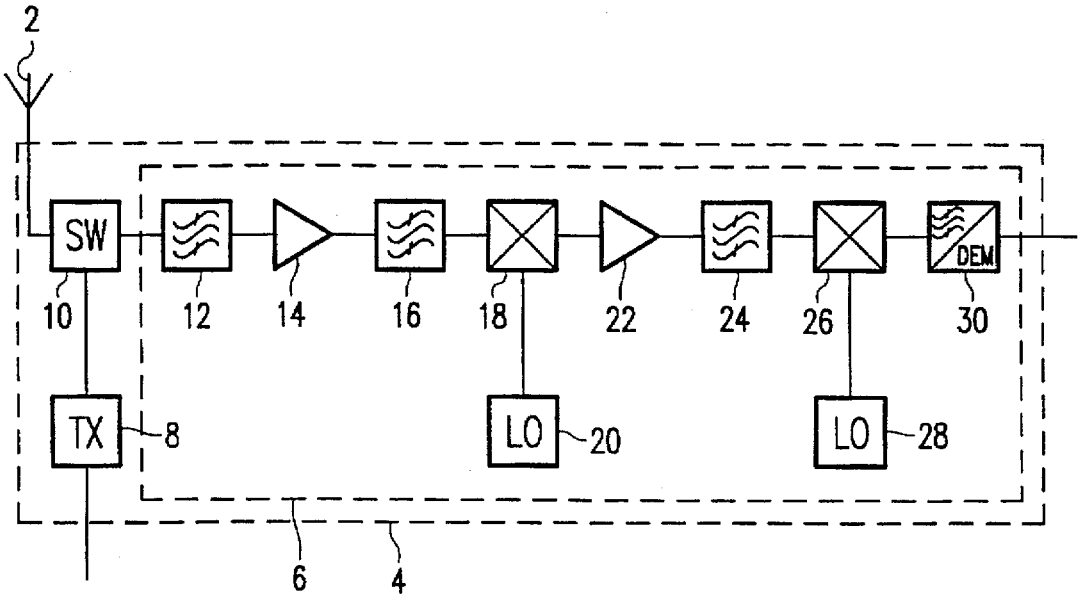
FIG. 1 shows a transceiver according to the invention.

In FIG. 1 an aerial 2 is connected to an input/output of the transceiver 4. The input/output of the transceiver 4 is connected to a transceiver switch 10. An output of the transceiver switch 10 is connected to an input of a receiver 6.

The input of the receiver 6 is connected to an input of a bandpass filter 12 according to the inventive idea. The output of the bandpass filter 12 is connected to an input of an amplifier 14. The output of the amplifier 14 is connected to an input of a bandpass filter 16 whose output is connected to a first input of the frequency converter means in this case formed by a first mixer 18. An output of a first oscillator 20 is connected to a second input of the first mixer 18. The output of the first mixer 18 is connected to an input of an amplifier 22. The output of the amplifier 22 is connected to an input of a SAW filter 24 (Surface Acoustic Wave). The output of the SAW filter 24 is connected to a first input of a second mixer 26. An output of a second oscillator 28 is connected to a second input of the second mixer 26. The output of the second mixer 26 is connected to an input of a filter/demodulator 30. The output of the filter/demodulator 30 also forms the output of the receiver 6. A signal to be transmitted is applied to a transmitter 8, whose output is connected to an input of the transceiver switch 10.

The transceiver 4 as shown in FIG. 1 is arranged to be used in a duplex transmission system in which the transmitter and receiver need not necessarily be switched on simultaneously. Examples of such transmission systems are GSM, PCN and DECT. The advantage of this is that the transceiver 4 may be considerably simpler than a transceiver arranged for full duplex operation in which transmitter and receiver can operate simultaneously. The latter transceivers require complex duplex filters to avoid the output signal of the transmitter ending on the input of the receiver.

If the transceiver switch 10 is in the receive mode, the received signal is transferred to the bandpass filter 12. For DECT this bandpass filter has a centre frequency of 1890 MHz and a bandwidth of 20 MHz. The output signal of the bandpass filter 12 is amplified by the amplifier 14 and subsequently applied to a bandpass filter 16 which is identical to the bandpass filter 12.

The output signal of the bandpass filter 16 is mixed in the mixer 18 with a signal coming from the first oscillator 20, which signal has a frequency in the range from 771–1787 MHz. The output signal of the mixer 18 is amplified by the amplifier 22 and the SAW filter 24 selects the component having a centre frequency of 110.592 MHz from the output signal of the amplifier 22.

This output signal is mixed in a second mixer 26 with a signal having a frequency of 100 MHz which comes from the second oscillator 28. The output of the mixer 26 then carries a signal that has a centre frequency of 10.592 MHz which is then filtered and demodulated by the filter/demodulator 30.

The signal to be transmitted is modulated on a carrier by the transmitter 8 which carrier has a frequency that is equal to that of the received signal in the case of DECT. The output signal of the transmitter 8 is conveyed to the aerial 2 via the transceiver switch 10.

The filter 12, 16 of FIG. 1 is realised with a multicoating technique. The filter consists of stacked foils which are sintered, during which operation the foils have at the proper places palladium tracks provided for forming strip line resonators and so on and so forth. It is conceivable that another metal such as, for example, copper or silver may be substituted for palladium. The sintering is preferably effected under a lateral pressure, so that the dimensions of the filter in the plane of the foils do not change during sintering. The foils are formed from a mixture of powder of a ceramic material and an organic binding agent. Said technique is described in more detail in U.S. Pat. No. 4,612,689. Alternatively, it is possible that the strip line resonators consist of two metal layers separated by a thin ceramic layer in lieu of a single metal layer. This leads to less attenuation of the filter in the passband.

Figure 2:
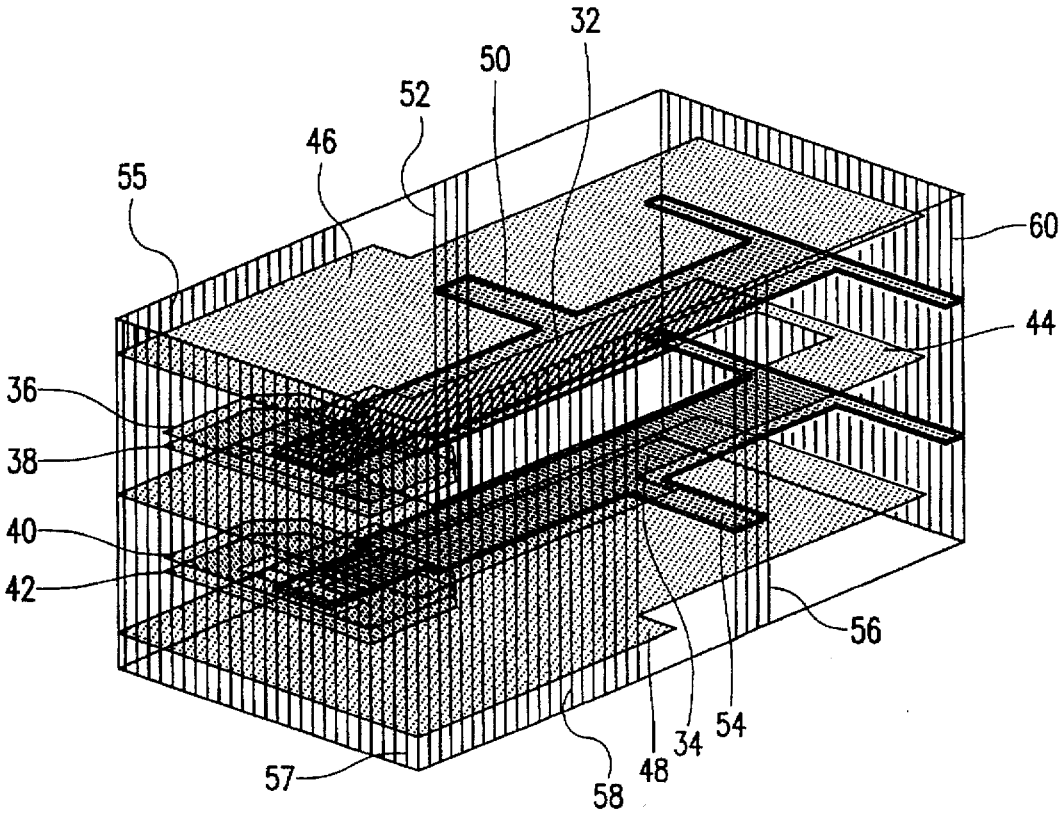
FIG. 2 shows filter according to the invention drawn in perspective.

The filter shown in FIG. 2 comprises a first base plate 46 and a second base plate 48 between which a first strip line resonator 32 and a second strip line resonator 34 are inserted. The first strip line resonator 32 and the second strip line resonator 34 are connected on one side, by a conductive side face 60, to a side of the first base plate 46 and the second base plate 48. The other side of the strip line resonators 32 and 34 are capacitively coupled to a conductive side face 57 via the capacitor plates 36 and 38 and capacitor plates 40 and 42, respectively. The conductive side face 57 is furthermore connected to the first base plate 46 and the second base plate 48. The strip line resonators have a length of $\lambda/8$. The capacitors are there to enable the strip lines 32 and 34 having length $\lambda/8$ to resonate. The strip line resonators 32 and 34 are coupled via a coupling opening in the further conductor 44 which is arranged between the strip line resonators 32 and 34. The size of the coupling opening determines the extent of coupling between the first strip line resonator 32 and the second strip line resonator 34. The input signal of the filter is applied to a contact 52 on the side face of the filter. This contact is coupled to the first strip line resonator 32 via an electroplated tap 50. The output signal of the filter is available on a contact 56 on the side of the filter. This contact is coupled to the second strip line resonator 34 via an electroplated tap 54. The conductors 55 and 58 on the side of the filter are there for the tuning of the filter. These conductors 55 and 58 are connected to the side face 57, to the first base plate 46 and to the second base plate 48. The filter is tuned by reducing the length of the conductor 55 and/or the conductor 58 by removing material from the end of that particular conductor by a laser. Such a filter of ceramic material containing BaNdTi oxide has dimensions of 3.2 mm×1.6 mm×1.5 mm for an 1890 MHz centre frequency.

Figure 3:
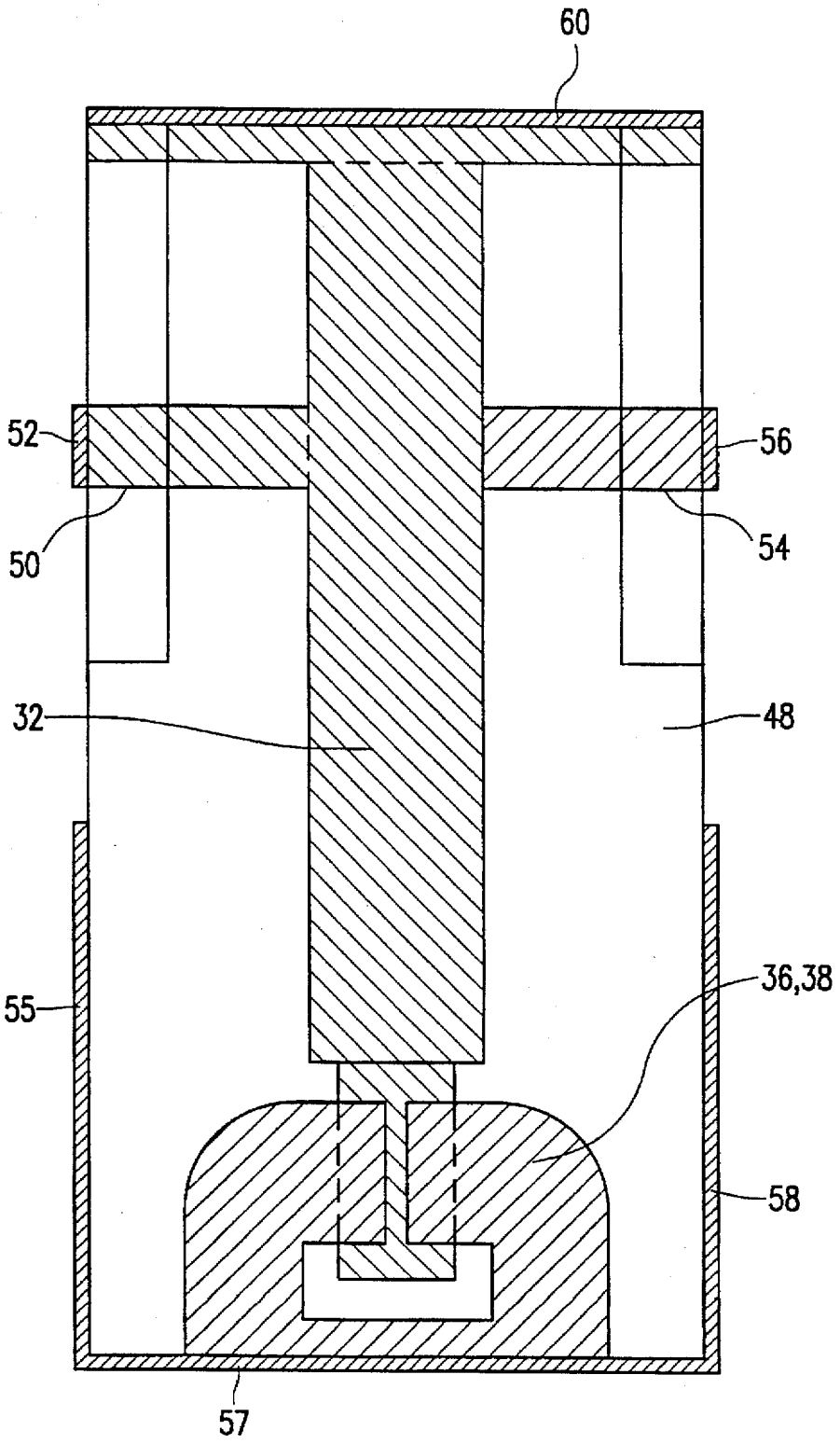
FIG. 3 shows a longitudinal section of the filter shown in FIG. 2.

In the cross-section shown in FIG. 3 of the filter of FIG. 2 is clearly visible the connection between the conducting side face 60 and an end of the strip line resonator 32. The other end of the strip line resonator 32 is capacitively coupled to the side face 57 via the capacitor plates 36 and 38. These capacitor plates are arranged in such a way that alignment faults do not affect the capacitance, because the overlapping surface remains the same in the case of minor relative shifts between capacitor plates 36 and 38 and strip line resonator 32. Pan of the base plate 48 has been removed to avoid short-circuiting between the contacts 52 and 56 and the base plate 48. The conductors 55 and 58 which may be shortened for the using of the filter are positioned on the outside of the filter, so that they are easily accessible for a laser beam which is used for the tuning.

Figure 4:
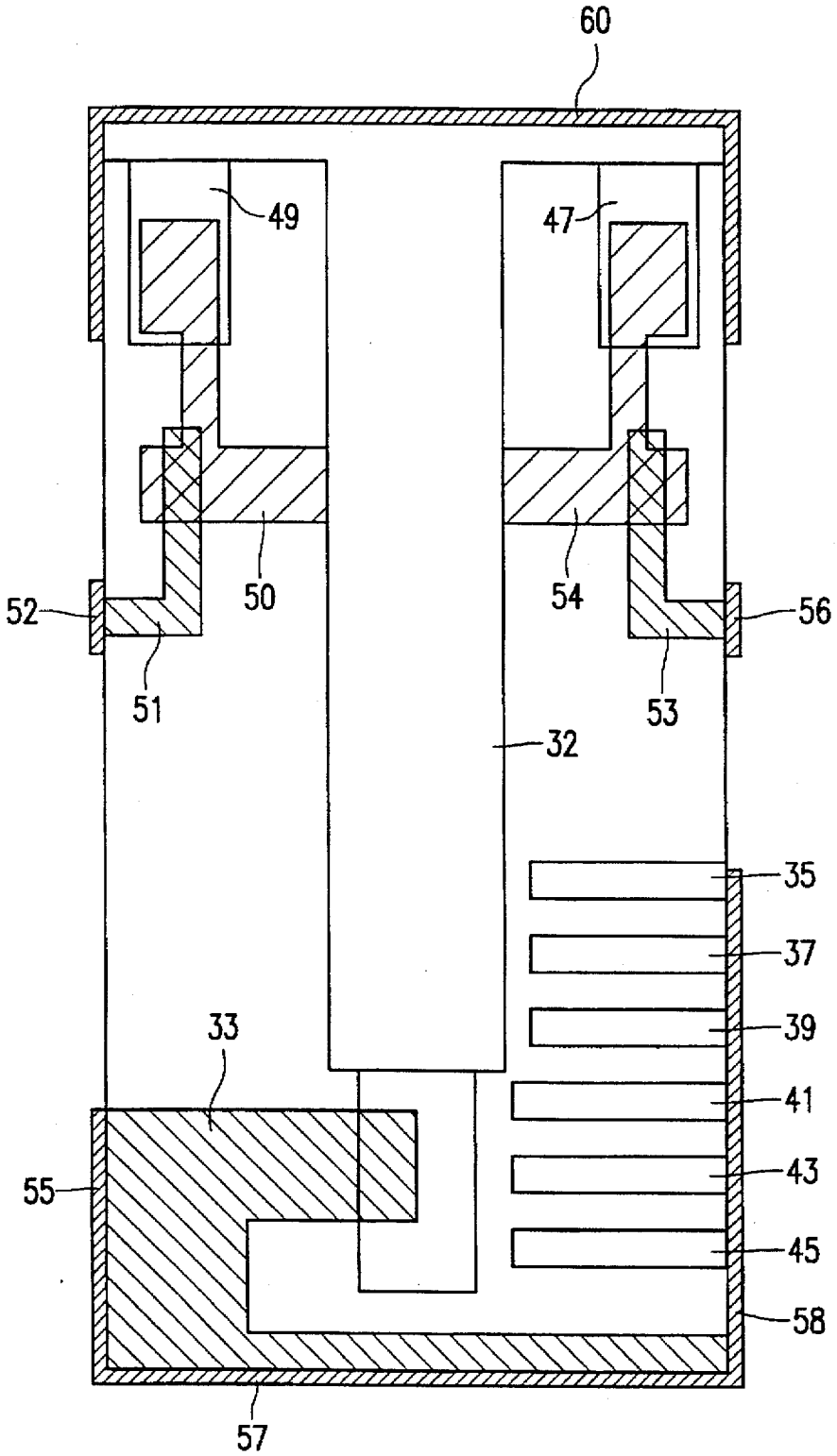
FIG. 4 shows longitudinal section of an alternative embodiment for the filter shown in FIG. 2.

In FIG. 4, in the sectional view of an alternative embodiment for the filter shown in FIG. 2, the input and output are coupled to the electroplated tap 50, 54 respectively, via a capacitive voltage divider. The contact 52 is capacitively coupled to the electroplated tap 50 by means of a strip 51 which partly overlaps the electroplated tap 50. The electroplated tap 50 is capacitively coupled to the conductive side face via a strip 49. The contact 56 is capacitively coupled to the electroplated tap 54 via a strip 53 which partly overlaps the electroplated tap 54. The electroplated tap 54 is capacitively coupled to the conductive side face 60 via a strip 47. The use of the capacitive coupling results in a lower attenuation of the filter in the passband.

The tuning of the filter shown in FIG. 4 is effected by cutting the conductor 58 through by a laser at a certain spot, so that one or more of the strips 35, 37, 39, 41, 43 and 45 are no longer connected to the conductor 58. The use of the strips 35, 37, 39, 41, 43 and 45 combined with the conductor 58 leads to an enlarged tuning range, because the ends of the strips are closer to the strip line resonators than the conductor 58. It is conceivable that a measurement of the transfer characteristic of the still untuned filter produces the spot where the conductor 58 is to be cut through to obtain the desired transfer characteristic.

Figure 5:
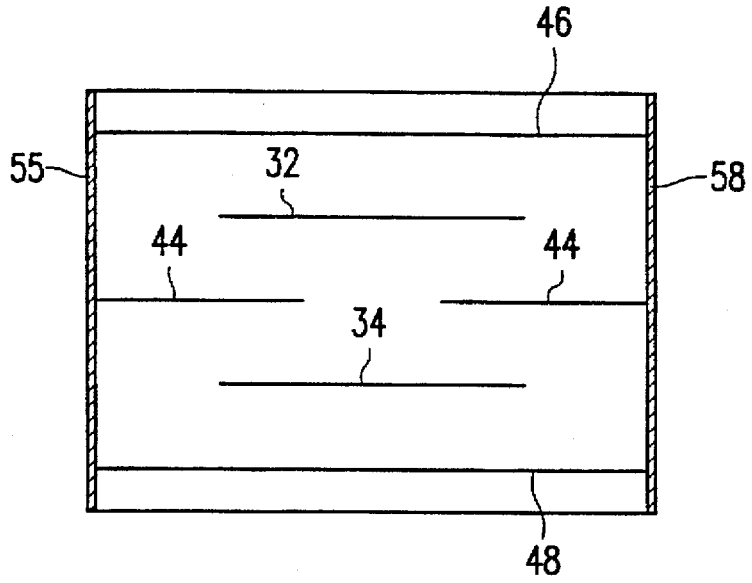
FIG. 5 shows a cross-section of the filter shown in FIG. 2.
Figure 6:
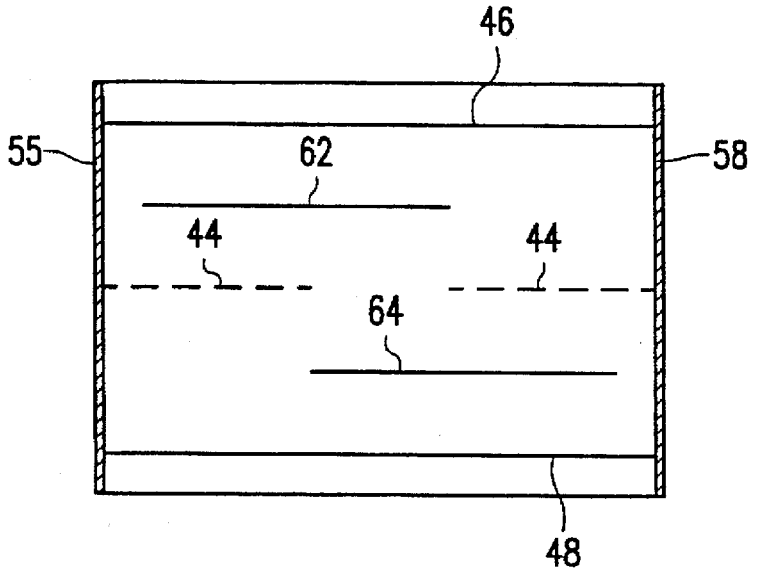
FIG. 6 hows a cross-section of a further embodiment for the filter shown in FIG. 2.

In the cross-section shown in FIG. 5, the strip line resonators 32 and 34 are coupled via a coupling opening in the further conductor 44. The two strip line resonators 32 and 34 are furthermore enclosed by the two base plates 46 and 48. In an alternative embodiment shown in FIG. 6 the strip line resonators 62 and 64 are shifted sideways. This sideways shift of the strip line resonators 62 and 64 leads to a smaller coupling between these strip line resonators, so that in some situations the conductor 44 may become redundant. Mother consequence of the sideways shift of the strip line resonators 62 and 64 is that the influence of the conductors 55 and 58 is enhanced as a result of the smaller distance between that particular conductor and one of the strip line resonators. This leads to an enlarged tuning range.

What is claimed is:

1. A filter comprising at least first and second mutually electromagnetically coupled strip line resonators, wherein the first and second strip line resonators are separated by the ceramic dielectric, the first and second strip line resonators are situated in first and second planes, respectively, that are adjacent and substantially parallel to each other, the first and second strip line resonators are electromagnetically coupled at least via the broad side, and a spatial arrangement of the first and second strip line resonators is such that an area of the first resonator has a substantial overlap with an area occupied by the second resonator.

2. The filter as claimed in claim 1, further comprising at least one conductor for influencing the electromagnetic field in the neighborhood of at least one of said first and second strip line resonators, wherein said at least one conductor has a length that is smaller than the length of one of said first and second strip line resonators.

3. The filter as claimed in claim 2, wherein the first and second strip line resonators are shifted sideways.

4. The filter as claimed in claim 2, further comprising at least a further conductor which has a coupling opening located between the first and second strip line resonators.

5. The filter as claimed in claim 4, wherein the first and second strip line resonators are shifted sideways.

6. The filter as claimed in claim 1, further comprising at least one conductor having a coupling opening located between the first and second strip line resonators.

7. The filter as claimed in claim 6, wherein the first and second strip line resonators are shifted sideways.

8. The filter as claimed in claim 1, wherein the first and second strip line resonators are shifted sideways.

9. A method of tuning a filter, the filter comprising at least first and second mutually electromagnetically coupled strip line resonators, wherein:

the first and second strip line resonators are separated by a ceramic dielectric, the first and second strip line resonators are located in first and second planes, respectively, that are adjacent and parallel to each other, the first and second strip line resonators are mutually electromagnetically coupled at least via the broad side, a spatial arrangement of the first and second strip line resonators is such that an area of the first resonator has a substantial overlap with an area occupied by the second resonator, the filter has at least one conductor for influencing an electromagnetic field in the neighbourhood of at least one of said first and second strip line resonators, the at least one conductor has a length that is smaller than the length of one of the first and second strip line resonators, and wherein the tuning comprises reducing the length of the at least one conductor.

10. The method as claimed in claim 9, wherein the reduction of the length of the at least one conductor is achieved by removing material from an end of the at least one conductor.

11. A high-frequency signal receiver of which one input is coupled to a filter comprising at least first and second mutually electromagnetically coupled strip line resonators, wherein:

the first and second strip line resonators are separated by a ceramic dielectric, the first and second strip line resonators are located in first and second planes, respectively, that are adjacent and substantially parallel to each other, the first and second strip line resonators are electromagnetically coupled at least via the broad side, a spatial arrangement of the first and second strip line resonators is such that an area of the first resonator has a substantial overlap with an area occupied by the second resonator and, the filter is coupled to a frequency converter for converting the high-frequency signal into a signal having a lower centre frequency.

12. The receiver as claimed in claim 11, wherein the filter comprises at least one conductor for influencing the electromagnetic field in the neighborhood of at least one of said first and second strip line resonators, and wherein said at least one conductor has a length that is smaller than the length of one of said first and second strip line resonators.

13. The receiver as claimed in claim 12, wherein the first and second strip line resonators are shifted sideways.

14. The receiver as claimed in claim 12, wherein the filter includes a further conductor with a coupling opening which opening is located between the first and second strip line resonators.

15. The receiver as claimed in claim 14, wherein the first and second strip line resonators are shifted sideways.

16. The receiver as claimed in claim 11, further comprising at least one conductor having a coupling opening located between the first and second strip line resonators.

17. The receiver as claimed in claim 16, wherein the first and second strip line resonators are shifted sideways.

18. The receiver as claimed in claim 11, wherein the first and second strip line resonators are shifted sideways.

* * * * *